US006688967B2

(12) United States Patent
Mafi et al.

(10) Patent No.: US 6,688,967 B2
(45) Date of Patent: Feb. 10, 2004

(54) VENTILATED COVER

(76) Inventors: Masoud Mafi, 110 Promenade Circle, Apartment 914, Thornhill, Ontario (CA), L4J 7W8; Fabian Bortolotto, 60 Kennard Street, Stoney Creek, Ontario (CA), L8J 2C6

( * ) Notice: Subject to any disclaimer, the term of this patent is extended or adjusted under 35 U.S.C. 154(b) by 0 days.

(21) Appl. No.: 10/191,464

(22) Filed: Jul. 10, 2002

(65) Prior Publication Data

US 2003/0027516 A1 Feb. 6, 2003

Related U.S. Application Data

(60) Provisional application No. 60/309,748, filed on Aug. 2, 2001.

(51) Int. Cl.[7] ..... F24F 7/00

(52) U.S. Cl. ..... 454/276; 454/82; 454/118

(58) Field of Search ..... 454/78, 82, 118, 454/254, 276, 184; 135/93; 2/DIG. 1; 174/16.1

(56) References Cited

U.S. PATENT DOCUMENTS 3,013,483 A * 12/1961 Knight ..... 454/78
3,024,717 A * 3/1962 Rozek ..... 454/275
4,407,187 A * 10/1983 Horney ..... 454/324

* cited by examiner

*Primary Examiner*—Harold Joyce

(57) ABSTRACT

A molded insert for attachment to material of a cover intended for outdoor use to cover an article has a front face, a back face, and a plurality of openings through its thickness. Each opening has a larger area in the front face than in the back face, and is formed so that the bottom-most extent of the smaller area in the back face is higher than the bottom-most extent of the larger area in the front face of the molded insert, when the molded insert is placed in a vertical orientation. There may be a first region in the molded insert where there are no openings formed. Typically, a peripheral margin is formed around the periphery, and an upstanding wall portion extends forwardly of the peripheral margin at least in the top region when the molded insert is placed in a vertical orientation.

20 Claims, 4 Drawing Sheets

VENTILATED COVER

REFERENCE TO PRIOR APPLICATION

This application claims priority from U.S. Provisional Patent Application Serial No. 60/309,748 filed Aug. 2, 2001.

FIELD OF THE INVENTION

This invention relates to ventilated covers, and in particular invention relates to the use of a molded insert which is placed in the material of a ventilated cover for purposes of ventilation thereof. The ventilated covers are intended for use particularly in outdoor situations, and are typically employed with such various household items as barbecues, air-conditioner heat exchangers and condensers, and patio furniture, as well as with other recreational items as boats and other watercraft, motorcycles, all terrain vehicles, snowmobiles, spare tire covers for sports utility vehicles, and so on.

BACKGROUND OF THE INVENTION

Throughout North America, and elsewhere, many persons store household items of various sorts outdoors. For example, in the northern parts of North America, household barbecues are quite often stored on the patio for the barbecue season. Indeed, many households keep a barbecue outdoors all year. In the southern parts of North America, just as in the north, barbecues and other household items are covered, but usually for different reasons.

Specifically, barbecues, air-conditioner heat exchangers and condensers—which cannot be removed indoors to other storage facilities in any event—and other seasonal household and recreational items such as those referred to above, may require to be covered for a variety of reasons. Typically, and in any event, they are covered during the winter seasons to protect them from the elements and the environment. Rain, snow, blowing leaves, dust, sand and so on, must be protected against. So also must the incursion of insects and rodents be protected against. On the other hand, fully covering any household items such as those described above is tantamount to an invitation to disaster. Damaging condensation, rusting and mildew, as well as or recreational cobwebs and spiders nests, and the like, may ensue.

However, if the covered household or recreational items are ventilated at the same time, then there is much less risk of any damaging condensation, rusting, mildew, cobwebs and spiders nests, and like, developing. This is because air can flow in and out of the shelter which is provided by a ventilated cover in keeping with present invention, unlike prior art covers which are not ventilated and which may give rise to serious damage to the very household articles that they are intended to protect.

Even in the middle of winter, a sunny day may result in significant air expansion within the interior of a cover over a household or recreational item. If the cover is ventilated, in keeping with present invention, then that air can flow out of the cover, taking with it stale air and moisture. Then, in the evening, as the sun goes down, ambient air pressure equilibrium will cause airflow back into the interior of the cover, thereby replacing fresh air for the previous stale air that has been expelled. This is particularly likely to happen because, almost invariably, covers for barbecues, air-conditioner heat exchangers, and the like, are dark colored and therefore will absorb radiant heat from such as sunshine. Still further, by the presence of ventilation in a cover, the relative humidity inside and outside of the cover will remain effectively at equilibrium, and thereby the chance of rust developing may be reduced, if not precluded.

However, the elements—and particularly rain, snow, and wind—are always present, and therefore it is not appropriate to ventilate a cover merely by the addition of a screen or a series of apertures formed in the material of the cover.

Thus, the present invention provides for appropriate baffles to preclude direct incursion of rain or snow as they may be carried by the wind, or insects and the like, but so as to permit airflow into and out of the interior of a cover when it is placed over a household or recreational article as described above. The details of such construction are, of course, described hereafter.

Effectively, the inventors herein provided at least one breathable section which may be placed into a material cover—typically, a tarpaulin-like material, a rubberized material, or other suitable plasticized or rubberized fabrics that have sufficient flexibility to be folded when not in use, and sufficient sewability or other adhesive characteristics that a cover for any designated household or recreational item of any shape may be constructed, as is well known to those in the cover industry.

Because rain and snow typically fall more or less downwardly, certain improved embodiments of ventilated covers, and particularly the molded insert set are intended for use with them, provide for additional protection against downwardly falling precipitation.

SUMMARY OF THE INVENTION

In accordance with one aspect of the present invention, there is provided a molded insert for attachment to the material of the cover intended for outdoor use to cover an article.

The molded insert has a front face, a back face, and a plurality of openings to its thickness. Each opening has a larger area in the front face then it has in the back face.

Each opening that is formed in the molded insert is such that the bottom-most extent of the smaller area of thereof in the back face of the molded insert is higher than the bottom-most extent of the larger area thereof in the front face of the molded insert, when the molded insert is placed in a vertical orientation.

There is a first region in the molded insert where there are no openings formed through the thickness thereof.

A molded insert in keeping with present invention may further comprised a peripheral margin around the periphery thereof, and an upstanding wall portion which extends forwardly of the peripheral margin at least in the top region thereof, when the molded insert is placed in a vertical orientation.

Still further, the upstanding wall portion may be formed entirely around the region occupied by the plurality of openings, but at the peripheral margin of the molded insert.

If so, then the upstanding wall portion may extend further forwardly of the peripheral margin at the top region and that a top portion of the side regions of the molded insert, then the remainder of the upstanding wall portion elsewhere.

In that case, the upstanding wall portion may have an upper surface in the top region thereof which slopes outwardly and downwardly from the peripheral margin of the molded insert, also in the top region thereof.

The plurality of openings which is formed in the molded insert our typically arranged in a plurality of horizontal rows and vertical columns, the horizontality and the verticality of the rows and columns being determined when the molded insert is placed in a vertical orientation.

Each of the openings which is formed in the molded insert is such that the openings have a lower surface in at least a portion of the bottom region thereof. Moreover, the lower surface is typically formed so as to slope forward and downwardly when the molded insert is placed in a vertical orientation.

Still further, each of the openings which is formed in the molded insert is formed so as to have an upwardly extending rear wall at the rear thereof wherein each of the openings opens to the back face of the molded insert.

The height of each rear wall in each of the openings is in the range of 40% to 60% of the maximum height of each respective opening at the front face thereof.

In most embodiments of the present invention, at least some of the plurality of openings will also have a downwardly extending centrally located wall parallel to the rear wall.

In those cases, the height of each of the downwardly extending centrally located walls is also typically in the range of 40% to 60% of the maximum height of the respective opening at the front face thereof.

Openings which do not have the centrally located wall may be formed in up to 50% of the total number of rows of openings of a molded insert in keeping with present invention, in the upper region thereof.

Typically, although not necessarily, the profile at the front face of each opening which is formed in a molded insert in keeping with present invention is circular. If so, then typically the profile of each opening at the back face of the molded insert is semi-circular.

The first region in the molded insert where there are no openings formed therein is typically adapted to receive a plaque which is secured thereto. That plaque is, typically, such as to carry the name of the manufacturer of the barbecue, air-conditioner heat exchanger, or other household item being covered.

Likewise, the first region may be adapted to have a logo molded therein.

The molded insert in keeping with present invention are flexible, and a typically molded from a material which is chosen from the group consisting of: flexible PVC, vinyl, glass fiber, rubber, and mixtures thereof.

Of course, is further object of the present invention to provide a cover for outdoor use to cover an article, where the cover comprises flexible waterproof material cut and sewn in a pattern so as to cover an intended article to be covered, and at least one molded insert which is in keeping with the foregoing descriptions thereof. The molded insert is, of course, placed in a region of the material so as to be oriented substantially vertically when the cover is in place over the intended article.

Typically, a cover which is in keeping with present invention will be such that the molded insert is secured to the flexible waterproof material of the cover at the peripheral margin of the molded insert.

Still further, they may typically be two molded inserts secured to the flexible waterproof material of the cover in regions which are opposed to one another when the cover is placed over an intended article.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
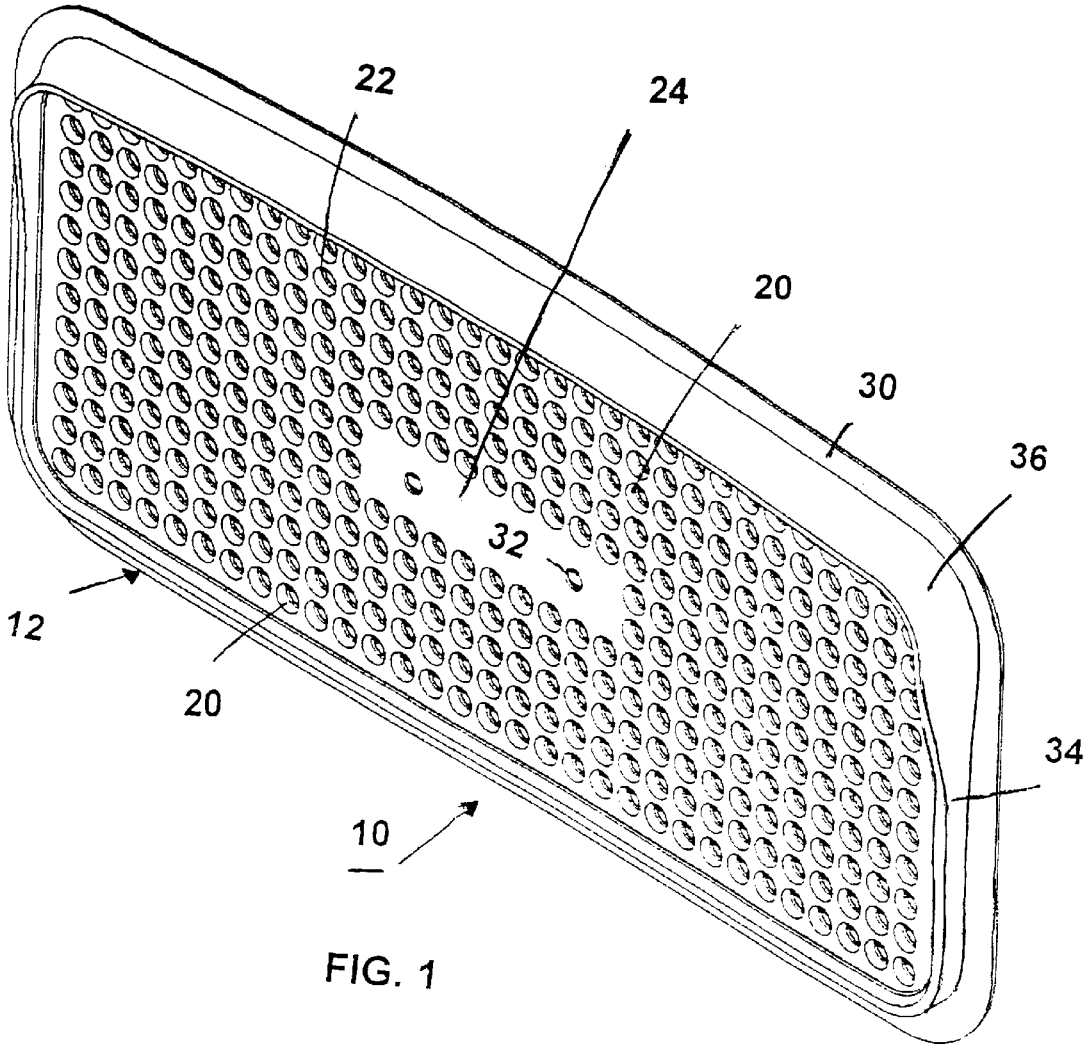
FIG. 1 is a perspective view of a typical embodiment of molded insert in keeping with present invention, viewed from the front.

The novel features which are believed to be characteristic of the present invention, as to its structure, organization, use and method of operation, together with further objectives and advantages thereof, will be better understood from the following discussion.

A molded insert which is particularly in keeping with the present invention is shown at 10 in FIGS. 1 to 4. The molded insert which is illustrated has a particular shape and embodiment which were chosen for purposes of utilization of the molded insert in a particular design of cover which was made comparing be placed over a barbecue. It will be very clear from an understanding of the descriptions which follow that the precise configuration, shape, and size of the molded insert are mere matters of choice and design, without bearing on the principles of the present invention as they are described herein.

The molded insert 10 has a front face 12 and a back face 14. There are a plurality of openings through the thickness of the molded insert 10, and they are shown at 20 and 22, respectively. The openings 20 are found throughout the major portion of the molded insert 10, but the openings 22 our typically found in at least one if not both of the top rows of openings, or even up to 50% of the rows of openings as discussed hereafter.

Figure 2:
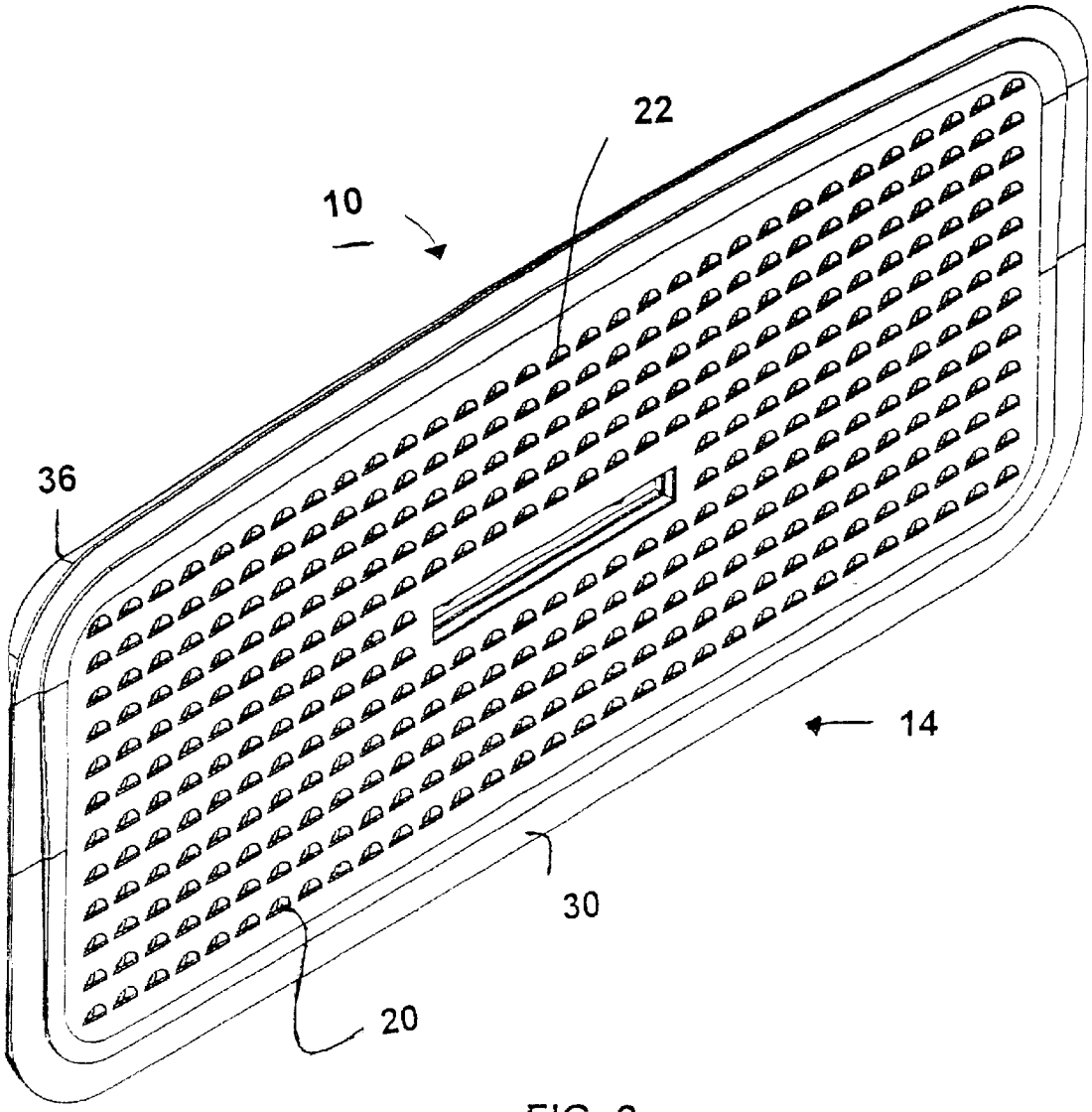
FIG. 2 is a perspective view of the molded insert of FIG. 1, viewed from the back.

It will be easily seen by comparing FIGS. 1 and 2 that each of the openings 20 or 22 has a larger area in the front face 12 of the molded insert 10, then in the back face 14 thereof.

It will also be noted, and will be described hereafter, that the bottom-most extent of the smaller area of each of the openings 20 and 22 as they are in the back face 14, as seen in FIG. 2, is higher than the bottom-most extent of the larger area of each of the openings 20 and 22 in the front face of the molded insert. This relationship is, of course, effective when the molded insert is placed in a vertical orientation.

Figure 6:
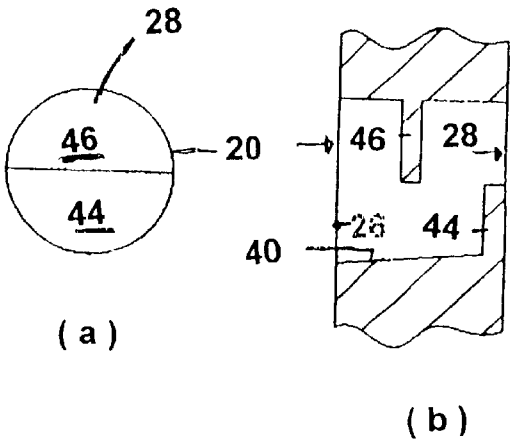
FIGS. 6(*a*) and (*b*) are a detail view of a second embodiment of openings formed in a molded insert in keeping with present invention.
Figure 5:
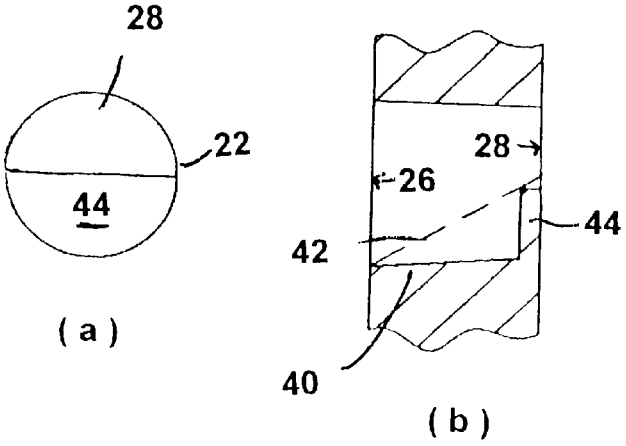
FIGS. 5(*a*) and (*b*) are a detail view of a first embodiment of openings formed in a molded insert in keeping with present invention.

Referring briefly to FIG. 5, or to FIG. 6, it will be seen that the region 26, which is the area of the opening of any of the openings 20 and 22 in the front face 12, is larger than the rear region 28, which is the area of any of the openings 20 and 22 in the back face 14.

There is also a first region 24 which may be formed in the molded insert, generally in the central region thereof, where there are no openings formed through the thickness of the molded insert. However, as seen hereafter, there may be a pair of screw holes 32 formed in the first region 24. The purpose of the first region 24 is described hereafter.

A peripheral margin 30 may be formed around the periphery of the molded insert 10. Still further, and upstanding walled portion 34 may be formed which extends for worthy of the personal margin 30 at least in the top region thereof when the molded insert is placed in a vertical orientation.

However, generally, the upstanding walled portion 34*s* formed entirely around the region occupied by the plurality of openings 20 and 22, and it is formed in such manner that the upstanding walled portion in the top portion 36 which is in the top region of the molded insert 10, extends further forward they in the top region and had a top portion of the side regions, then the remainder of the outstanding walled portion. This is seen particularly in FIGS. 1 and 4.

Figure 4:
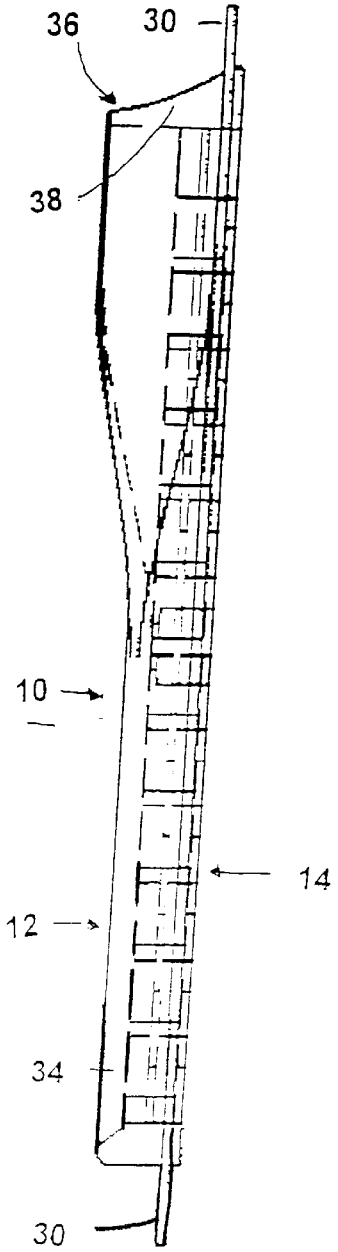
FIG. 4 is a side elevation of the molded insert of FIG. 1, viewed from the right.

Typically, the upstanding walled portion in the top region of the molded insert has an outwardly and downwardly sloped upper surface 38, as seen particularly in FIG. 4.

It will be understood, of course, that the plurality of openings 20 and 22 is generally arranged in a plurality of horizontal rows and vertical columns. It has previously been noted that the issue of horizontality and verticality is determined when the molded insert 10 is placed in a vertical orientation. In any event, of the plurality horizontally disposed rows of openings, typically the openings in the top two horizontally disposed rows are designated 22, and have a different configuration then the remaining openings 20 in the other horizontally disposed rows.

However, as seen particularly in FIGS. 5 and 6, each of the openings 20 and 22 is typically formed so that the lower surface 40 sloped forward they and downwardly. Indeed, because the openings 22 are configured in such a manner that they differ from the openings 20, as will be described hereafter, they may alternatively be formed with a sloping bottom surface 42 as shown in dashed lines in FIG. 5(*b*).

More usually, however, each of the openings 20 and 22 are formed with an upwardly extending rear wall 44 at the rear thereof where each of the openings 20 and 22 opens to the back face 14 of the molded insert 10. This is seen particularly in FIGS. 5(*a*) and 6(*a*).

Also seen in FIG. 6 is a downwardly extending centrally located wall 46 which is formed parallel to the rear wall 44. However, the walls 46 and 44 are found only in openings 20, and the downwardly extending centrally located walls 46 do not appear in any of the openings 22.

Typically, the height of each of the rear walls 44 of any of the openings 20 or 22 is in the range of 40% to 60% of the maximum height of the respective openings 20 or 22 in the front face 12 of the molded insert 10.

Likewise, the height of the centrally located downwardly extending wall 46 is also typically in the range of 40% to 60% of the maximum height of the respective openings 20 or 22 in the front face 12 of the molded insert 10.

In some cases, as many as 50% of the number of rows and openings in the molded insert 10 may be such as openings 22, not having the centrally located wall 46. If so, then typically those openings 22 are found only in the upper region of the molded insert 10, when it is placed in a vertical orientation.

Figure 3:
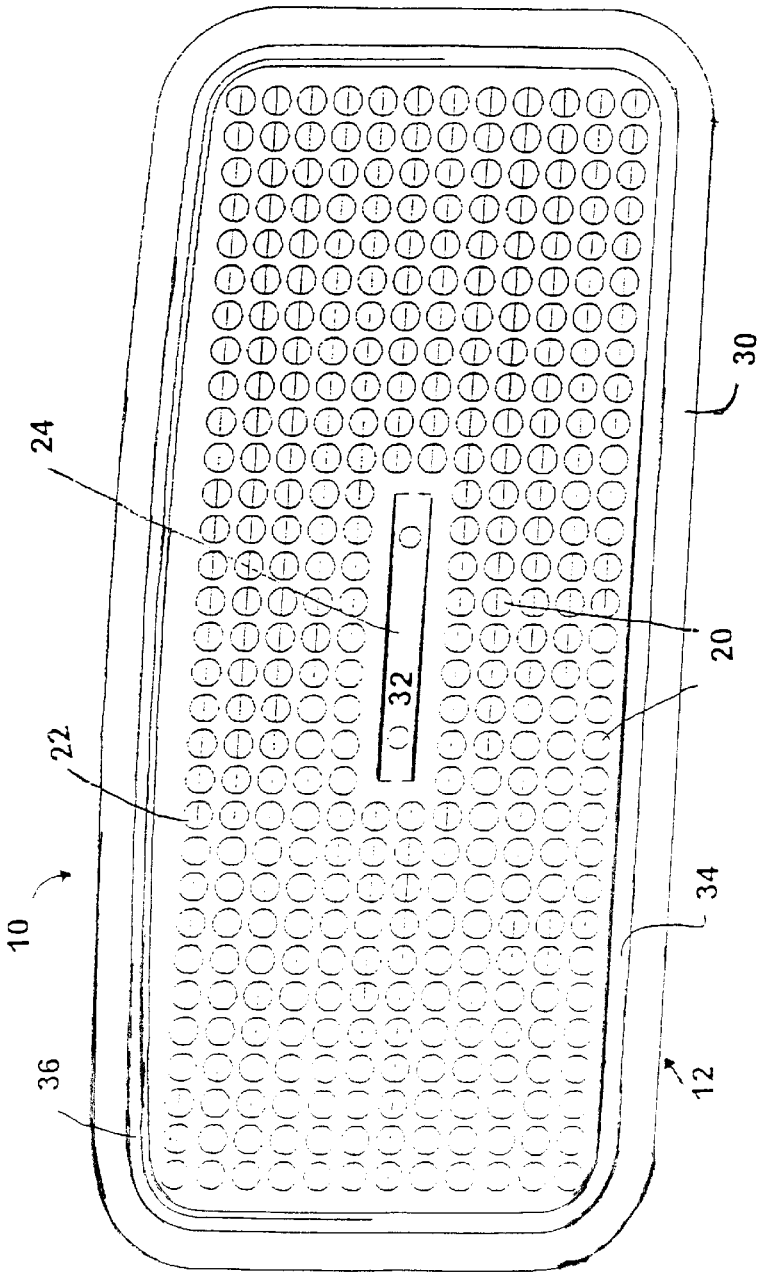
FIG. 3 is a front elevation view of the molded insert a FIG. 1.

FIGS. 1 and 3 suggest that the profile of each opening in the front face of the molded insert 10 may be circular. While that is a typical configuration, is not specific, and the profile of each opening 20 or 22 may be oval, square or rectangular, or any other defined shape, provided that the other characteristics concerning a sloping bottom surface and the disposition of a rear wall or other configuration to assure a smaller size of opening in the back face 14, and the disposition of the centrally located downwardly extending walls 46 in the openings 20, are otherwise satisfied.

Of course, when the profile of the openings 20 and 22 in the front face 12 of the molded insert 10, is circular, then in follows that the profile of each of the openings 20 and 22 in the back face 14 is semicircular, as is seen in FIG. 2.

Referring briefly to the region 24 having screw holes 32 formed therein, it will be understood that the purpose of that region is to accommodate a plaque bearing the name of a manufacturer thereon. Typically, the name is that of the manufacturer of the barbecue, air-conditioner heat exchanger or condenser, or other household or recreational item which is to be covered by a cover which incorporates the molded insert 10, or typically two such molded inserts, as discussed hereafter.

However, it may also be possible that a logo which may be that of the manufacturer may be molded directly into the molded insert 10 in the region 24 thereof.

It will be understood that the molded insert must have a certain amount of flexibility. Thus, it is difficult that the molded insert will be molded from a suitable material such as flexible PVC, vinyl, glass fiber, rubber, and mixtures thereof.

Figure 7:
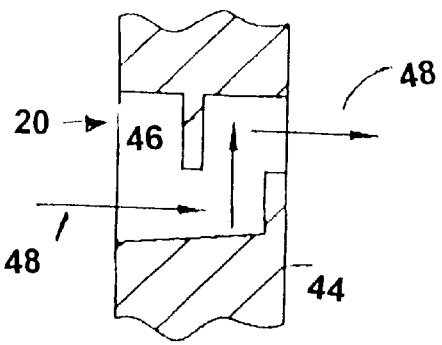
FIG. 7 shows a typical airflow pattern through a baffled opening such as that of FIG. 6.

It will be seen in FIG. 7 that a typical airflow through an opening 20 may follow arrows 48. However, this sense of the arrows—that is, their direction—may be also in the opposite direction than that which is shown, depending on whether airflow is into or out of the interior of a cover when it is in place over an article, as discussed above.

It will be clearly understood that the molded insert of the present invention is particularly intended to be incorporated into a flexible waterproof cover which will be used outdoors to cover any intended article, typically a household or recreational item such as a barbecue, an air-conditioner heat exchanger or condenser, patio furniture, bicycles or motorcycles, or even larger item such as vehicles, trailers, and the like. Because such covers will vary significantly in shape, size, and configuration, but each will incorporate at least one and typically two molded inserts 10 which are in keeping with the present invention, the specific appearance of such a cover will be well understood to those skilled in the art.

Accordingly, it will be understood that whenever a cover for outdoor use to cover an article incorporates at least one molded insert in keeping with the teachings hereof, the molded insert will be placed in a region of the flexible waterproof material which is cut and sewn to the desired configuration in such a location that when the cover is in place over an intended article, it will be oriented substantially vertically.

Typically, the molded insert or inserts 10 are secured to the flexible waterproof material of the cover at the peripheral margin of the insert or inserts.

It will also be understood that, especially when two molded inserts are employed, they will typically be located in regions of the flexible waterproof material of the cover where they will be opposed one to another when the cover is in place over the intended article.

It will be understood from the above discussions that covers which incorporate molded inserts in keeping with the present invention, and as described above, it will serve all the purposes which had been noted above. In particular, pressure and relative humidity equilibrium can be reached between the interior of the cover incorporating at least one molded insert in keeping with the present invention, and the ambient surrounding air temperature, relative humidity, and pressure. Moreover, the influx or incursion of debris such as leaves or twigs, as well as of insects, spiders, rodents, and the like, will be precluded as a consequence of the placement and configuration of the openings, the rear walls thereof, the centrally located downwardly depending walls of some but not all of the openings, and the presence of the upstanding wall portion particularly in the top region of the molded insert.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially vertical is intended to mean perpendicular to a horizontal orientation, or near so, and/or exhibiting characteristics associated with a general vertical element or orientation.

What is claimed is:

1. A molded insert for attachment to material of a cover intended for outdoor use to cover an article;

said molded insert having a front face, a back face, and a plurality of openings through its thickness, wherein each opening has a larger area in said front face than in said back face; and wherein each opening is formed so that the bottom-most extent of the smaller area thereof in the back face of said molded insert is higher than the bottom-most extent of the larger area thereof in the front face of said molded insert, when said molded insert is placed in a vertical orientation.

2. The molded insert of claim 1, further comprising a first region in said molded insert where there are no openings formed through the thickness thereof.

3. The molded insert of claim 1, further comprising a peripheral margin around the periphery thereof, and an upstanding wall portion which extends forwardly of the peripheral margin at least in the top region thereof when said molded insert is placed in a vertical orientation.

4. The molded insert of claim 3, wherein said upstanding wall portion is formed entirely around the region occupied by said plurality of openings at said peripheral margin; and wherein said upstanding wall portion extends further forwardly of the peripheral margin at the top region and at a top portion of the side regions thereof, than the remainder of the upstanding wall portion.

5. The molded insert of claim 4, wherein said upstanding wall portion has an upper surface which slopes outwardly and downwardly from said peripheral margin.

6. The molded insert of claim 1, wherein said plurality of openings is arranged in a plurality of horizontal rows and vertical columns when said molded insert is placed in a vertical orientation.

7. The molded insert of claim 6, wherein said openings are formed having a lower surface in at least a portion of the bottom region thereof, wherein said lower surface slopes forwardly and downwardly when said molded insert is placed in a vertical orientation.

8. The molded insert of claim 7, wherein each of said openings is formed so as to have an upwardly extending rear wall at the rear thereof where each said opening opens to said back face.

9. The molded insert of claim 8, wherein the height of each said rear wall is in the range of 40% to 60% of the maximum height of the respective opening at the front face.

10. The molded insert of claim 9, wherein at least some of said plurality of openings have a downwardly extending centrally located wall parallel to said rear wall; and wherein the height of each said centrally located wall is in the range of 40% to 60% of the maximum height of the respective opening at the front face.

11. The molded insert of claim 10, wherein openings not having said centrally located wall are formed in up to 50% of the total number of rows of openings in the upper region of said molded insert.

12. The molded insert of claim 1, wherein the profile of each opening at the front face is circular, and the profile of each opening at the back face is semi-circular.

13. The molded insert of claim 8, wherein the profile of each opening at the front face is circular, and the profile of each opening at the back face is semi-circular.

14. The molded insert of claim 2, wherein said first region is adapted to receive a placque secured thereto.

15. The molded insert of claim 2, wherein said first region is adapted to have a logo molded therein.

16. The molded insert of claim 1, wherein said molded inset is flexible, and is molded from a material chosen from the group consisting of: flexible PVC, vinyl, glass fiber, rubber, and mixtures thereof.

17. A cover for outdoor use to cover an article, said cover comprising flexible waterproof material cut and sewn in a pattern so as to cover an intended article to be covered, and at least one molded inset according to claim 1, placed in a region of said material so as to be oriented substantially vertically when said cover is in place over said intended article.

18. A cover for outdoor use to cover an article, said cover comprising flexible waterproof material cut and sewn in a pattern so as to cover an intended article to be covered, and at least one molded inset according to claim 3, placed in a region of said material so as to be oriented substantially vertically when said cover is in place over said intended article; and wherein said at least one molded insert is secured to said flexible waterproof material at its peripheral margin.

19. The cover of claim 16, wherein two molded insets are secured to said flexible waterproof material in regions which are opposed to one another when said cover is placed over an intended article.

20. The cover of claim 17, wherein two molded insets are secured to said flexible waterproof material in regions which are opposed to one another when said cover is placed over an intended article.

* * * * *